United States Patent [19]

Nieuwendijk et al.

[11] Patent Number: 4,703,232

[45] Date of Patent: Oct. 27, 1987

[54] COMBINATION OF A MONOCHROME CATHODE-RAY TUBE AND A DEFLECTION UNIT HAVING A HIGH RESOLUTION

[75] Inventors: Joris A. M. Nieuwendijk; Werner A. L. Heijnemans; Albertus A. S. Sluijterman; Nicolaas G. Vink, all of Eindhoven, Netherlands

[73] Assignee: U.S. Philips Corporation, New York, N.Y.

[21] Appl. No.: 873,461

[22] Filed: Jun. 6, 1986

Related U.S. Application Data

[63] Continuation of Ser. No. 324,230, Nov. 23, 1981, abandoned.

[30] Foreign Application Priority Data

Dec. 5, 1980 [NL] Netherlands ..... 8006628

[51] Int. Cl.[4] ..... H01J 29/56; H01H 1/00

[52] U.S. Cl. ..... 315/370; 335/213

[58] Field of Search ..... 335/213, 210, 212; 315/370, 371

[56] References Cited

U.S. PATENT DOCUMENTS 3,430,169 2/1969 Gabor ..... 335/213

4,109,220 8/1978 Peart ..... 335/212

4,143,345 3/1979 Barkow ..... 335/212

4,229,720 10/1980 Heijnemans et al. ..... 335/213

4,396,897 8/1983 Sluijterman et al. ..... 335/210

4,409,578 10/1983 Beelaard et al. ..... 335/210

*Primary Examiner*—Theodore M. Blum

*Assistant Examiner*—Gregory C. Issing

*Attorney, Agent, or Firm*—Robert J. Kraus

[57] ABSTRACT

A combination of a monochrome cathode-ray tube with a deflection unit for applications which require high resolution. The deflection unit produces a magnetic field having a six-pole component which is positive on the screen side to minimize raster distortion and which, in the deflection center, has a strength and polarity sufficient to minimize spot distortion. Preferably the effective length 1 of the deflection field satisfies the conditon $$\hat{1} \geqq (0.2\tau^2 + 0.25)L,$$

where L represents the distance between the deflection center and the display screen and $\tau$ is the tangent of the deflection angle of the electron beam for maximum deflection.

6 Claims, 18 Drawing Figures

COMBINATION OF A MONOCHROME CATHODE-RAY TUBE AND A DEFLECTION UNIT HAVING A HIGH RESOLUTION

This is a continuation of application Ser. No. 324,230, filed Nov. 23, 1981, now abandoned.

BACKGROUND OF THE INVENTION

The invention relates to a monochrome cathode ray display tube of the type having a display screen and an electron gum assembly for producing an electron beam and a deflection unit mounted on said display tube such that their longitudinal axes substantially coincide. The deflection unit comprising a line deflection coil system which when energised deflects the electron beam in a first direction, a field deflection coil system which when energised deflects the electron beam in a direction transverse to said first direction, an annular core member of soft magnetic material surrounding at least the line deflection coil system. The deflection unit has a first end facing said display screen and a second end adjacent said electron gun assembly. The deflection unit, when energized, produces dipole magnetic deflection fields resulting from said line and field deflection coils of substantially the same shape.

The deflection unit for deflecting the electron beam is used to deflect the electron beam from its normal undeflected straight path in one or in the other direction so that the beam impinges on selected points of the display screen so as to provide visual indications thereon. By varying the deflection magnetic fields in a suitable manner, the electron beam can be moved over the vertical display screen either upward or downward and to the left or to the right. By simultaneously modulating the intensity of the beam a visual presentation of information or a picture can be formed on the display screen. The deflection unit, which is coaxially arranged around the neck portion of the cathode-ray tube comprises two deflection coil systems so as to be able to deflect the electron beam in two transverse directions. Each system comprises two coils which are positioned on oppositely located sides of the tube neck with the systems being arranged around the tube neck 90° relative to each other. Upon energization, the two deflection coil systems produce orthogonal deflection fields. The fields are essentially perpendicular to the path of the undeflected electron beam. A core of magnetisable material, which for deflection coil systems of the saddle type is situated closely around these systems, serves to concentrate the deflection magnetic fields and to increase the flux density within the tube neck.

Most prior art combinations of cathode-ray tube-deflection yoke have been manufactured for consumer television apparatus typically having 625 lines per frame (picture). Due to their restricted resolving power such combinations are not suitable for the display of texts or graphic representations. Thus there is a demand for monitors having a high resolving power which are designed so as to be able to display texts and graphic data much more clearly than the apparatus for domestic use.

In such monochrome cathode-ray tubes of high resolving power (hereinafter termed monochrome DGD (Data Graphic Display), a larger number of lines per frame is employed than is usual and also at a higher frequency.

In such tubes, certain requirements must be met. The spot must be sufficiently small in the centre of the screen and any distortion must remain particularly small upon deflection over the screen.

The first requirement can be fulfilled by using rotationally symmetrical converged electron beams having a comparatively large angular aperture (on the basis of the law of Helmholz-Lagrange). (Since the electron beam upon deflection becomes overfocused as a result of the curvature of the field, it is usual to use dynamic focusing to correct for this). However, when using a beam having a large angular aperture in general there is another spot growth mechanism which deteriorates the spot upon deflection of the beam, so that it is difficult to simultaneously satisfy the second requirement. A further requirement in monochrome DGD's is for very small North-South and East-West raster distortion.

In the conventional DGD deflection units which generate substantially homogeneous deflection magnetic fields, the spot quality can be maintained within acceptable limits but this is at the expense of the North-South and East-West raster distortion. Although the raster distortion can be compensated for electronically in the deflection circuit while maintaining the spot quality, this solution is economically unattractive. There is also a solution which needs no electronic correction in the deflection circuit. However, this involves the use of strong static magnets on the screen side of the deflection unit for the correction of the raster distortion, which has the disadvantage that upon deflection of the beam the magnets deteriorate the spot quality. If one is not satisfied with the spot quality which is achieved with this method, this can be improved by using so-called 4-pole corrections on the gun side of the deflection unit. These 4-pole corrections have even been considered to be indispensible when an extremely high resolution is desired (this requires the use of an electron beam having a very large angular aperture). For economic reasons such dynamically driven 4-pole corrections are to be avoided.

SUMMARY OF THE INVENTION

It is an object of the invention to provide monochrome DGD systems which without electronic correction in the deflection circuit, and without the use of 4-pole corrections achieve both minimum North-South and East-West raster distortion and the spot quality needed for high resolution.

For that purpose a display tube with a deflection unit of the kind mentioned in the opening paragraph is characterized according to the invention in that said magnetic fields have the effect on the electron beam of having screen-sided positive sixpole magnetic field components of a strength sufficient to warrant minimum raster distortion, and of having an integral sixpole magnetic field component of a strength and a polarity sufficient to warrant the spot quality required for high resolution. The invention thus describes a distinct field shaping for display tube-deflection unit combinations which are to have a high resolution. What is achieved herewith is the following.

The positive sixpole component of both the line and the field deflection magnetic fields at the screen end of the deflection unit influences the North-South and East-West raster distortion such that the pincushion distortion which results from a substantially homogeneous (dipolar) deflection magnetic field as is produced by the conventional DGD deflection unit is substantially absent.

Depending on the effective length of the magnetic deflection fields, the strength and polarity of the integral six-pole component is selected to achieve good spot quality. In combination with relatively long deflection fields a weakly negative sixpole component, or even a substantially zero sixpole component, may be needed. The shorter the effective field length, the stronger the positive sixpole component which may be needed. In most practical cases the strength of the positive six-pole component needed for minimum raster distortion is substantially greater than the strength of the positive six-pole component needed for good spot quality. This incompatibility may be solved by producing a negative six-pole component about the centre of the deflection field of such a strength that as regards the spot the integral six-pole component has the required value. This is based on the fact that measures taken on the screen side of the deflection magnetic field influence the raster distortion comparatively most strongly, while about the centre of the field it is the astigmatism errors which are most influenced. By producing about the centre of the deflection field a six-pole component which is adapted to the length of the field and to the positive six-pole component at the screen side, an equally good spot quality can be achieved all over the screen. As has been mentioned already the effective field length $\hat{l}$ plays an important role. As $\hat{l}$ becomes shorter, the six-pole field component of the (line and/or field) deflection magnetic field must integrally become more and more positive so as to obtain a good spot quality at least in the corners of the display screen. In order not to need to make the positive sixpole field component of the deflection field too strong, which adversely effects the spot quality on the axes, it is of importance that the effective field lengths should not be too short. According to a preferred embodiment of the invention the effective field length $\hat{l}$ of at least one of the dipolar deflection magnetic fields should for that purpose satisfy the condition:

$$\hat{l} \geqq (0.2\tau^2 + 0.25)L$$

where L represents the distance between the deflection point and the display screen and $\tau$ is the tangent of the deflection angle of the electron beam for maximum beam deflection.

This means that the effective field length is dependent on the deflection point-display screen distance and on the maximum deflection angle.

E.g. if arc tan $\tau = 35°$ (70° display tube); $\hat{l} \geqq 0.35$ L arc tan $\tau = 45°$ (90° display tube); $\hat{l} \geqq 0.45$ L arc tan $\tau = 50°$ (100° display tube); $\hat{l} \geqq 0.54$ L arc tan $\tau = 55°$ (110° display tube); $\hat{l} \geqq 0.65$ L So the greater the maximum deflection angle, the stronger the requirement as regards $\hat{l}$. In comparison with the field length in self-converging 110° deflection systems, for which $\hat{l} \approx 0.50$ L, the field length in high resolution monochrome 110° deflection systems should be substantially longer. To simplify design of the deflection coil system, auxiliary means which locally amplify the effect of the positive six-pole component of the deflection magnetic field may be used. Various embodiments of auxiliary means which are practically useful within the scope of the invention will be described hereinafter.

BRIEF DESCRIPTION OF THE DRAWING

The invention will now be described in greater detail, by way of example, with reference to the accompanying drawing in which.

DESCRIPTION OF THE PREFERRED EMBODIMENTS

Figure 1:
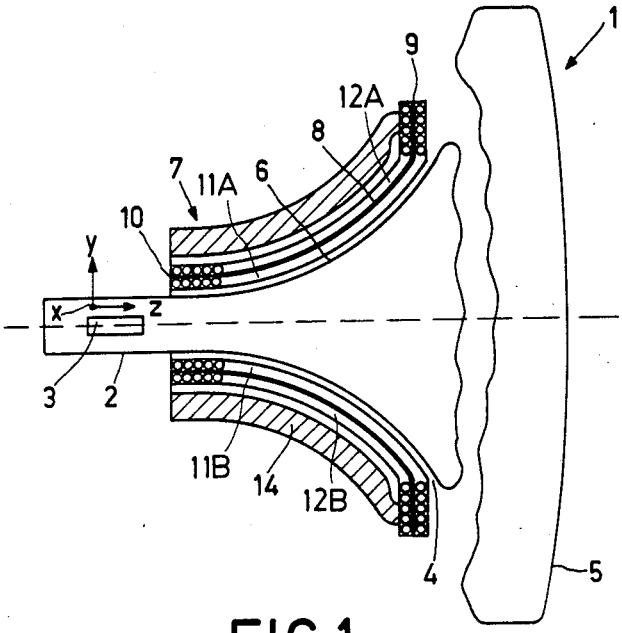
FIG. 1 is a diagrammatic cross-sectional view (taken on the y-z plane) of a cathode ray tube with a deflection unit mounted thereon.
Figure 4:
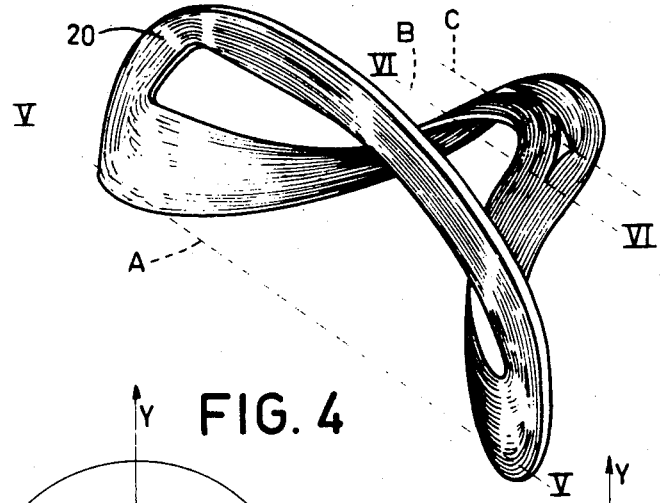
FIG. 4 is a perspective view of one deflection coil of a system of deflection coils characteristic of the invention.

FIG. 1 is a cross-sectional view taken on the y-z plane of a cathode-ray tube having an envelope 6 which varies from a narrow neck portion 2 in which the electron gun 3 is mounted to a wide cone-shaped portion 4 which has a display screen 5. A deflection unit 7 is mounted on the tube at the transition between the narrow and wide portions. This deflection unit 7 comprises a cap or support 8 of insulating material having a front end 9 and a rear end 10. Between these ends 9 and 10, on the inside of the cap 8, a system of deflection coils 11A, 11B is provided for generating a (line) deflection magnetic field for deflecting an electron beam produced by the electron gun 3 in a horizontal direction on the outside of the cap 8 a system of coils 12A, 12B is provided for generating a (field) deflection magnetic field for deflecting an electron beam produced by the electron gun in the vertical direction. The deflection coil systems 11A, 11B, and 12A, 12B are surrounded by an annular core 14 of a magnetisable material. The individual coils of the deflection coil systems are each of the saddle type such as is shown in FIG. 4.

Figure 2:
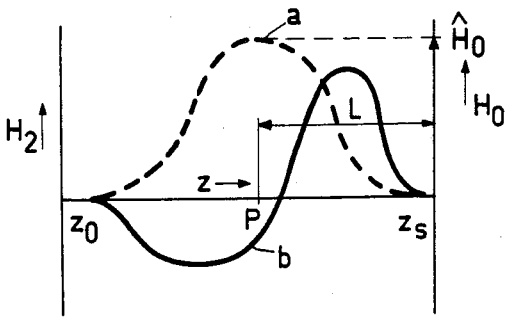
FIGS. 2 and 3 show with reference to the parameter $H_o$ the strength along the z-axis of a dipolar deflection magnetic field and with reference to the parameter $H_2$ the strength of the sixpole field component.

Primarily the invention prescribes deflection coil systems for producing the magnetic field intensity and magnetic field shape respectively shown by curves a and b in FIG. 2, in which the line and field deflection magnetic fields are of substantially the same shape. An example of an appropriate field shaping is shown in FIG. 2. The magnetic field parameters $H_o$ and $H_2$ plotted vertically in FIG. 2 on the right and on the left respectively are known to those skilled in the present art where $H_o$ is the magnetic field intensity along the z-axis and $H_2$ is the magnetic field intensity of the six-pole component of the deflection magnetic field. As is known, a di-pole field plus a six-pole field produces a pincushion shaped field (if the six-pole is positive) or a barrel-shaped field (if the six-pole field is negative).

Referring to FIG. 2, curve a the effective field length $\hat{l}$ of the deflection magnetic field is defined as:

$$\hat{l} = \frac{\int H_o\, dz}{H_o}$$

For achieving a good spot-quality $\hat{l}$ must preferably satisfy the condition:

$$\hat{l} \geqq (0.2.\tau^2 + 0.25)L \qquad (1)$$

where L is the distance between the deflection point P and the screen (FIG. 2 centre and right hand side) and $\tau$ is the tangent of the deflection angle of the electron beam for maximum beam deflection.

FIG. 2 curve b shows the six-pole magnetic field component $H_2$ of the line deflection field which has a similar variation as the six-pole magnetic field component $V_2$ of the field deflection field (not shown) from the gun side ($z_o$) to the screen side ($z_s$).

By carefully adjusting the positive lobe of the six-pole field component at the screen side and the negative lobe about the centre of the magnetic deflection field raster distortion can be minimized and the spot quality can be optimized.

Figure 3:
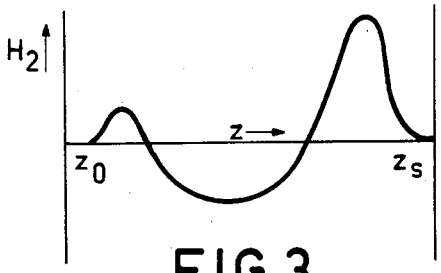

A modification of the six-pole field variation shown in curve b of FIG. 2 is shown in FIG. 3. This magnetic field variation may be considered as a refinement of that shown in FIG. 2 in that by introducing an extra six-pole field modulation on the gun side of the deflection field coma abberation can be reduced, which is of importance in particular when electron beams are used having a large angular aperture.

Figure 5:
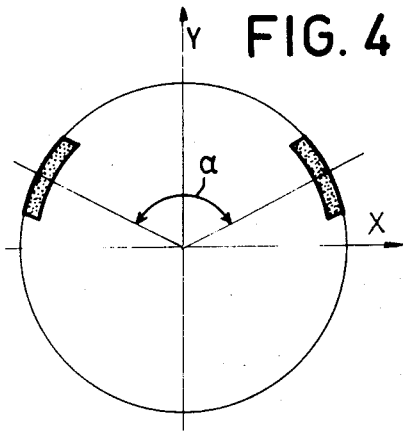
FIGS. 5 and 6 represent two different cross-sections through the coil of FIG. 4, showing the specific wire distribution.
Figure 6:
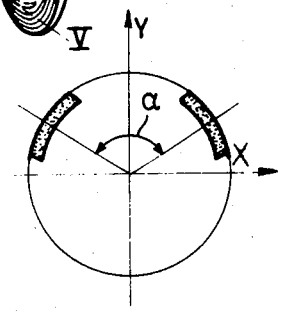

One of a pair of coils for a deflection coil system by means of which the magnetic field variation of FIG. 3 can be produced and which may be used in a deflection unit for a display tube having a large maximum deflection angle is shown in FIG. 4. This is realised by making the average window aperture $\alpha$ between the wires forming the coil near the gun side the narrow part of the aperture less than 120° and greater than 120° at the screen side (the wide part of the aperture) and furthermore dividing the wires on the side C of the coil (20) remote from the display screen on both sides into at least two sections separated by an aperture. FIG. 5 shows the position of the windings in a cross-section along the line A in FIG. 4 and FIG. 6 shows the position of the windings in a cross-section along the line B in FIG. 4.

With large maximum deflection angles for the electron beam (such as a 110° deflection angle) it may become very difficult to realise the required extent of the six-pole field variation by means of the wire positioning of the coils only. Therefore hereinafter several embodiments are described which show how by means of simple auxiliary means the same effect as that of the above-described positioning of the windings is achieved.

Figure 7:
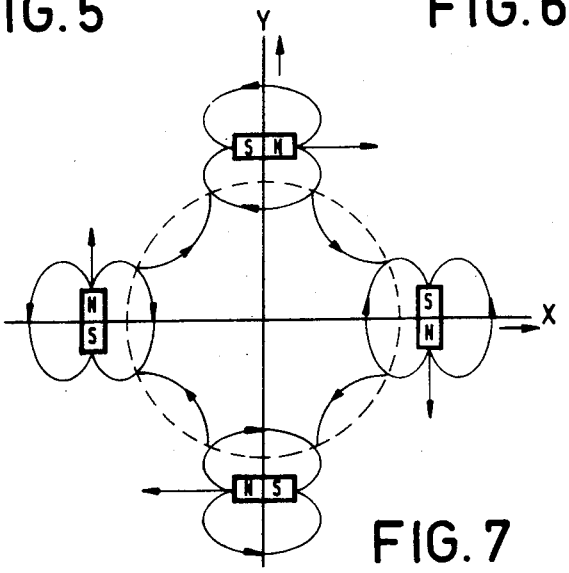
FIGS. 7 and 8 show configurations of 4 permanent magnets which can be used within the scope of the invention.
Figure 8:
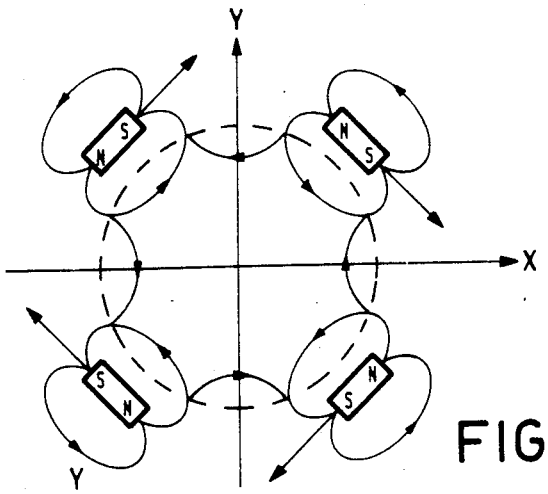

An embodiment of the invention uses an auxiliary means configuration of permanent magnets as shown in FIG. 7 and/or FIG. 8.

Figure 9A:
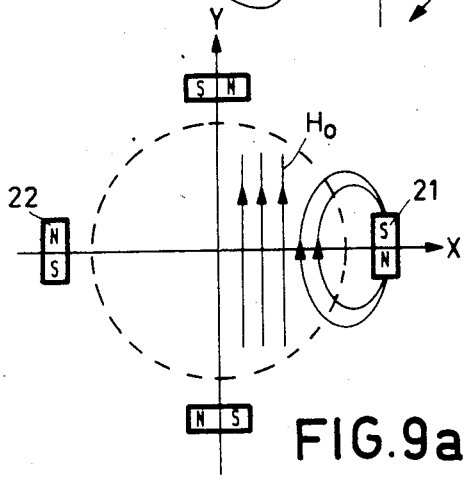
FIGS. 9*a* and 9*b* show the effect of the magnet configuration of FIG. 7 on a line deflection magnetic field during two different situations.
Figure 10A:
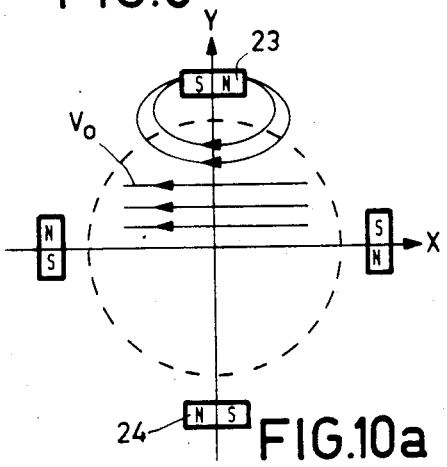
FIGS. 10*a* and 10*b* show the effect of the magnet configuration of FIG. 8 on a field deflection magnetic field during two different situations.
Figure 9B:
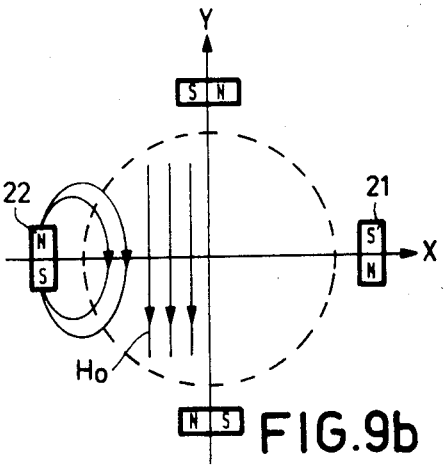
Figure 10B:
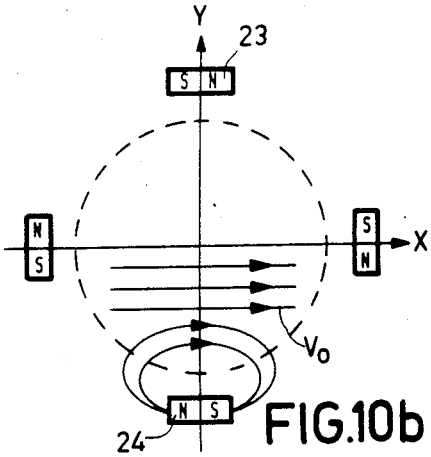

The FIG. 7 configuration of four permanent magnets provides, together with the dipole deflection magnetic field, the same effect as if a more pincushion-like magnetic field were produced locally both by the line and field deflection coil systems. This is explained with reference to FIGS. 9*a* and 9*b*. During the positive part of the (line) stroke (that is to say the electron beam is present on the right-hand side of the screen) the line deflection magnetic field $H_o$ is directed vertically upward and together with the nearest magnet (21) provides locally a (positive) quasi-pincushion field. During the negative part of the (line) stroke (FIG. 9*b*) the line deflection magnetic field $H_o$ is directed vertically downwards and, together with the nearest magnet (22) provides locally a (negative) quasi-pincushion field. For the field deflection field $V_o$ and the magnets (23, 24) exactly the same reasoning may be followed (FIGS. 10*a* and 10*b*).

So the positive static eight-pole magnetic field produced by the FIG. 7 configuration ensures that the nearby magnetic fields for the line and the field deflection coil systems each have a stronger positive six-pole component. It will be obvious that when the polarisation of the magnets in FIG. 7 is opposite to that shown the line and field magnetic fields will be more barrel-shaped.

From an analogous reasoning applied to the FIG. 8 configuration of four permanent magnets it follows that this configuration locally produces more pin-cushion-shaped line and field deflection magnetic fields. For FIG. 8 it also holds that with magnets oppositely poled to those shown locally more barrel-shaped line and field deflection magnetic field are formed. The magnets in FIG. 8 are shifted 45° relative to those shown in FIG. 7. The invention thus also relates to a deflection unit having the effect of the magnetic field shaping according to curve b of FIG. 2 or 3 in which an auxiliary means in the form of a configuration of magnets as shown in FIGS. 7 and/or 8 is used on the screen side of the deflection unit so as to make the magnetic field locally more pincushion-shaped.

In this case it is considered advantageous that at a slightly retracted position (but still on the screen side half of the unit) static magnets of an opposite polarity are arranged. In other words: the positive static 8-pole magnetic field necessary for raster correction is combined, at a distance in the z-direction slightly more to the gun side (but still on the screen side), with negative 8-pole magnetic field.

The effect which is achieved herewith is that an undesired influencing of the spot quality by the configuration of magnets nearest to the screen, especially when strong magnets are employed can be compensated for by the oppositely polarised magnets. Thus it can be achieved by means of a double arrangement of magnets that the net influence on the spot quality is zero, while a net influence on the raster errors remains.

Figure 11A:
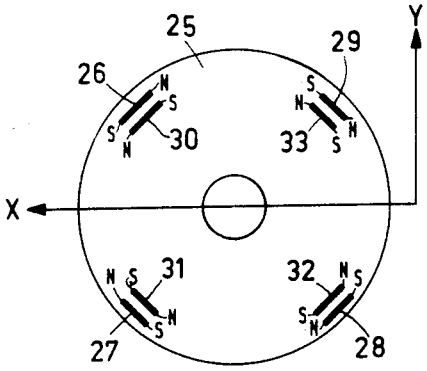
FIG. 11*a* shows with reference to a rear view of a display tube and FIG. 11*b* shows with reference to a side view of a display tube the location of a double configuration of static magnets which may be used within the scope of the invention.
Figure 11B:
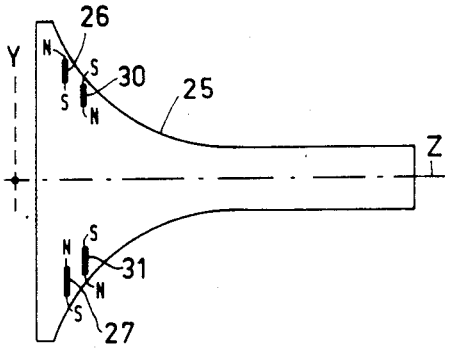

One of the possible embodiments of a double arrangement of magnets is shown diagrammatically in FIG. 11*a*, which represents a rear view of a display tube 25, and FIG. 11*b*, which represents a side view of the display tube 25 of FIG. 11*a*. Coaxially arranged with respect to the longitudinal axis of the display tube are a first configuration of permanent magnets 26–29 for producing a positive static eight-pole field and a second configuration of magnets 30–33 for producing a negative static eight-pole field.

In the foregoing deflection coil systems have been described with in principle a magnetic field shaping according to curve b of FIG. 2 or 3 whether or not the auxiliary means of FIGS. 7 and 8 were used, in which equation (1) is satisfied (that is to say a rather long deflection unit), having for its purpose: a good spot quality over the whole screen in combination with a minimum North-South and East-West raster distortion.

However, the invention is not limited to deflection units which satisfy the requirements of equation (1).

In principle an equally good spot quality can be obtained all over the screen when equation (1) is satisfied. However, the term "good spot quality" is not an absolute standard. In one field of application of monochrome display-tube-deflection unit combinations more resolution is necessary than in another one.

The following relates to a variation of the inventive concept, which variation bears upon display-tube-deflection unit combinations which do not satisfy equation (1), that is to say the deflection units produce deflection magnetic fields which are shorter than the minimum value required in equation (1), which are substantially free from North-South and East-West raster distortion and nevertheless show an acceptable spot quality, albeit not necessarily uniform over the whole screen.

Figure 12:
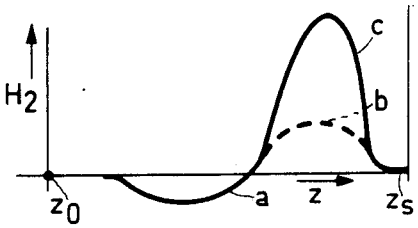
FIGS. 12 and 13 show with reference to the parameter $H_2$ the respective variation of six-pole field components characteristic of two embodiments of the invention.
Figure 13:
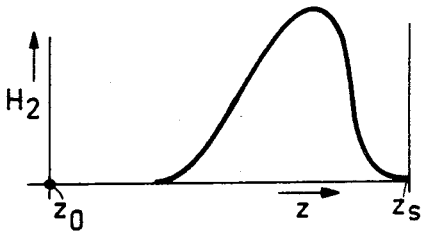

As the effective field length $\hat{l}$ deviates more from equation (1) (as the deflection unit becomes shorter), the integral value of the six-pole component of the line and field deflection magnetic fields become more positive, so that in an extreme case the magnetic field shape of FIG. 12, curve c may even change into that of FIG. 13.

In this manner the North-South and East-West raster distortion is at a minimum, the spot quality in the corners of the screen can be warrented, but on the axes the spot quality may be slightly less.

If it is not convenient to achieve the field shaping of FIG. 12, curve c, or of FIG. 13, only by a specific positioning of the windings of the coils of the coil systems, a configuration of static magnets as described before may be added so as to obtain the desired magnetic field shape. E.g. in combination with a line deflection coil system and a field deflection coil system which, on the gun side, produce a relatively weak negative six-pole field component (see curve a, FIG. 12) and which on the screen side produce a relatively weak positive six-pole field component (see curve b, FIG. 12) the effective field lengths of which systems are smaller than indicated in equation (1), the magnet configurations of FIGS. 7 and/or 8 may be used to produce on the screen side a stronger positive six-pole field component (see curve c, FIG. 12).

In the above description the invention has been explained with reference to the use of saddle shaped coils of the special type shown in FIG. 4 in which the end of the gun side does not make an angle with the tube's longitudinal axis (as the end of the screen side), but is parallel to the tube axis, whether or not in combination with the auxiliary means of FIGS. 7 and/or 8.

It will be realised that normal type saddle coils or, if desired, toroidal coils or combinations thereof may be used for producing deflection magnetic fields of the required shaping.

Also it will be realised that for different applications the inventive concept may be worked out in different ways.

An example of what is meant hereby is the following.

Figure 14A:
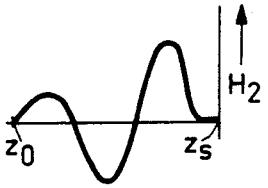
FIGS. 14*a* and 14*b* show with reference to the parameter $H_2$ the variation of the six-pole component of the line deflection field and with reference to the parameter $V_2$ the variation of the field deflection field, respectively produced by a deflection unit for use with a display tube having a screen of the T.V. format.
Figure 14B:
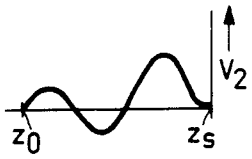

When the display screen is viewed with its major dimension in the horizontal direction horizontal format (as in broadcast television) the integral value of the six-pole component $H_2$ of the line deflection magnetic field should be greater than that of the field deflection magnetic field for optimization of the spot quality. Compare FIG. 14*a* (six-pole component $H_2$ of line deflection magnetic field) with FIG. 14*b* (six-pole component $V_2$ of field deflection magnetic field). In the case where the display screen is viewed with its major dimension in the vertical direction (so-called vertical format) this is just the reverse: the integral value of the six-pole component of the field deflection magnetic field must then be greater than that of the line deflection magnetic field.

What is claimed is:

1. A monochrome cathode ray display tube including a display screen, an electron gun assembly for producing an electron beam, and a deflection unit mounted on the tube such that its longitudinal axis substantially coincides with that of the electron gun assembly, said deflection unit comprising a line deflection coil system for deflecting the electron beam in a first direction, a field deflection coil system for deflecting the electron beam in a direction transverse to said first direction, and an annular core member of soft magnetic material surrounding at least the line deflection coil system, said deflection unit having a first end facing said display screen and a second end adjacent to said electron gun assembly, characterized in that said line and field deflection coil system are arranged for producing similarly-shaped dipole deflection fields, each of said fields including a six-pole component which, near said first end, is of positive polarity and of sufficient strength to minimize raster distortion, and which, near the center of the deflection field, is of a negative polarity and of a sufficient strength to minimize beam distortion with deflection of the beam, at least one of said fields having an effective length $\hat{l}$ satisfying the condition:

$$\hat{l} \geqq (0.2\tau^2 + 0.25)L,$$

where L represents the distance between the deflection field center and the display screen, and where $\tau$ is the tangent of the deflection angle of the electron beam at maximum deflection.

2. A display tube as claimed in claim 1, characterized in that the integral value of the six-pole magnetic field component resulting from one of the deflection coil systems is larger than that of the other deflection coil system.

3. A display tube as claimed in claim 1, characterized in that near the center of the deflection field the six-pole magnetic field components have strengths which are smaller than the strengths of the positive six-pole magnetic field components near said first end.

4. A display tube as claimed in claim 1 or 3, including a first configuration of permanent magnets, which generate a positive static 8-pole field, placed on the screen side of the deflection unit.

5. A display tube as claimed in claim 4 incuding a second configuration of permanent magnets, which generate a negative static 8-pole field, placed between the deflection unit and first configuration of permanent magnets.

6. A display tube as in claim 1, characterized in that the coils of at least one of the coil systems are of the saddle type and have an average window aperture between the windings forming the coil which near the second end is less than 120° and at the first end is greater than 120°.

* * * * *